United States Patent [19]

Makino et al.

[11] 4,093,453

[45] June 6, 1978

[54] METHOD OF MAKING AN ORDERED ALLOY

[75] Inventors: Yoshimi Makino, Fujisawa; Satoru Uedaira; Shigeyasu Ito, both of Yokohama, all of Japan

[73] Assignee: Sony Corporation, Tokyo, Japan

[21] Appl. No.: 639,121

[22] Filed: Dec. 9, 1975

[30] Foreign Application Priority Data

Dec. 20, 1974 Japan ..... 49-146423

[51] Int. Cl.[2] ..... C22C 33/00; C22C 1/00

[52] U.S. Cl. ..... 75/129; 75/135; 148/1; 148/4

[58] Field of Search ..... 148/1, 4, 13, 13.1, 148/13.2, 20.3, 14, 16, 134, 180; 75/135, 129

[56] References Cited

U.S. PATENT DOCUMENTS

| | | | |
|---|---|---|---|
| 3,554,739 | 1/1971 | Bickerdike et al. | 75/135 |
| 3,637,374 | 1/1972 | Holzi et al. | 75/135 |
| 3,886,002 | 5/1975 | Akimov et al. | 148/180 |

*Primary Examiner*—R. Dean

*Attorney, Agent, or Firm*—Hill, Gross, Simpson, Van Santen, Steadman, Chiara & Simpson

[57] ABSTRACT

A method of making a substantially ordered alloy which involves providing a metal base consisting of at least one of the ingredients of the desired alloy, depositing a thin metal layer on the base, the metal layer containing the remaining constituents of the desired alloy, and heating the metal base and the deposited metal layer at a temperature below the order-disorder transformation temperature of the ordered alloy to be formed to thereby cause the ordered alloy to be produced by diffusion.

9 Claims, 7 Drawing Figures

METHOD OF MAKING AN ORDERED ALLOY

BACKGROUND OF THE INVENTION

1. Field of the Invention

This invention relates to a method of making a substantially ordered alloy by inter-diffusing the constituents of the alloy wherein at least one of the constituents is in the form of a thin film.

2. Description of the Prior Art

In normal substitutional solid solutions, the different kinds of atoms are arranged at random on a common lattice. There are some cases, however, where alloys which at high temperatures consist of random substitutional solid solutions undergo atomic rearrangement on slow cooling or annealing at a low temperature. This rearrangement produces an ordered structure in which the different kinds of atoms take up regular positions in the lattice. In copper-gold alloys, for example, an alloy containing 25 atomic percent gold ($Cu_3Au$) at high temperatures consists of a face-centered cubic structure with a random distribution of the two kinds of atoms. Upon annealing at a low temperature, the alloy is rearranged so that the gold atoms occupy the corners of the cube and the copper atoms occupy the centers of the faces. This type of structure is known as an ordered structure or sometimes as a superlattice.

When the atomic arrangement of alloys is transformed from the disordered phase to the ordered phase, various physical characteristics may be changed. Among the properties which may be changed as the alloy becomes more ordered are its electrical resistance, its Hall mobility, its magnetic properties, its Young's modulus, its volume, its mechanical hardness, its resistance to abrasion, its resistance to corrosion, and the like. Accordingly, ordered alloys can sometimes be used as magnetic recording media, in magnetic heads, for electrical contacts, ornaments and the like.

According to one prior art method of making a substantially ordered alloy, the metallic elements which form the desired alloy are melted with predetermined atomic percentages to prepare an alloy ingot which is then subjected to a suitable heat treatment. With this type of prior art method, it is difficult to make a desired ordered alloy, and it is virtually impossible to make such an alloy as a thin layer.

It has also been proposed in the prior art to make an ordered alloy by contacting metal plates made up of elements which will form the ordered alloy, and diffusing them by means of heat treatment. In such cases, the diffusion should be carried out at a temperature lower than the order-disorder transformation temperature of the ordered alloy, so that the diffusion requires a long period of time and is commercially impractical. If the diffusion is carried out at a temperature higher than the order-disorder transformation temperature, the concentration of the diffused element in one of the metal components is decreased from the surface to the interior exponentially and the diffusion portion which has the proper concentration ratio necessary to form the ordered alloy becomes extremely thin.

SUMMARY OF THE INVENTION

The present invention is based upon the discovery that if a layer consisting of one of the elements in the desired ordered phase is deposited on a metal base consisting of the remaining element or elements by electroplating, electroless plating, vapor deposition, chemical vapor deposition, sputtering, or the like, and thereafter the base and the deposited layer are heated at a temperature lower than the order-disorder transformation temperature of the alloy, a substantially ordered alloy layer integral with the metal base is produced.

The ordered alloy referred to in the specification and claims does not necessarily mean that the atomic arrangement of the alloy is completely in the ordered form, but that the alloy is substantially ordered so that the atomic arrangement is predominantly in the ordered phase.

The temperature involved in the thermal diffusion between the two layers varies in accordance with the time, the nature of the element or elements in the deposited layer, and the nature of the element or elements in the metal base. Consequently, it is difficult to provide threshold values of the thermal diffusion temperature even though a particular species of an alloy is involved. Generally speaking, however, if the diffusion of the two elements is not completed in a period of 1 day, it is uneconomical from an industrial point of view. Thus, if a source of radiation such as a gamma ray or the like is irradiated on the metal layer before or during the thermal diffusion process, the speed of diffusion increases even though a relatively low temperature is involved.

BRIEF DESCRIPTION OF THE DRAWING

Other objects, features and advantages of the invention will be readily apparent from the following description of a preferred embodiment thereof, taken in conjunction with the accompanying drawing, although variations and modifications may be effected without departing from the spirit and scope of the novel concepts of the disclosure, and in which.

DESCRIPTION OF THE PREFERRED EMBODIMENTS

Figure 1A:
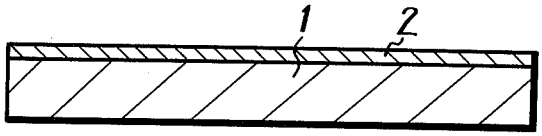
FIGS. 1A and 1B are cross-sectional views on a greatly enlarged scale illustrating the steps involved in one example of a method of making a substantially ordered alloy according to this invention.
Figure 1B:
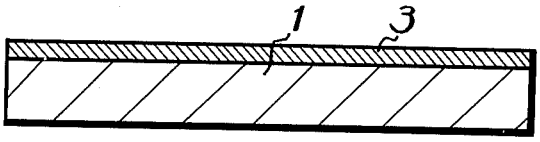

An example of the methods involved for making a binary alloy having an ordered phase according to this invention will now be described with reference to FIGS. 1A and 1B. When the desired binary alloy is, for example, a copper-gold binary alloy, the metal base 1 may be provided composed of copper. On the metal base 1 there is deposited the other element, gold, as a gold layer 2 with an arbitrary thickness, without quantification, by plating, vapor deposition, sputtering or the like. Then, if the copper base 1 with the gold layer 2 is heat treated at a temperature lower than the order-disorder transformation temperature which is 380° C in the case of the alloy CuAu, a substantially ordered alloy 3 of a predetermined thickness is formed on the surface of the copper base 1 as shown in FIG. 1B.

If the coated base is subjected to further heat treatment, for a longer period of time, the layer 3 becomes a layer of ordered alloy $Cu_3Au$. When heat treatment is carried out at a temperature of 500° C which is higher than the order-disorder transformation temperature, no ordered alloy is formed.

In this case and in succeeding cases, it is preferred that the thickness of the deposited layer should not exceed about 10 microns because if the thickness is larger than 10 microns, the adhesion of the deposited layer to the metal base may be deteriorated by the stress of the deposited layer so that the deposited layer may be peeled off from the metal base during the heat treatment.

Figure 2:
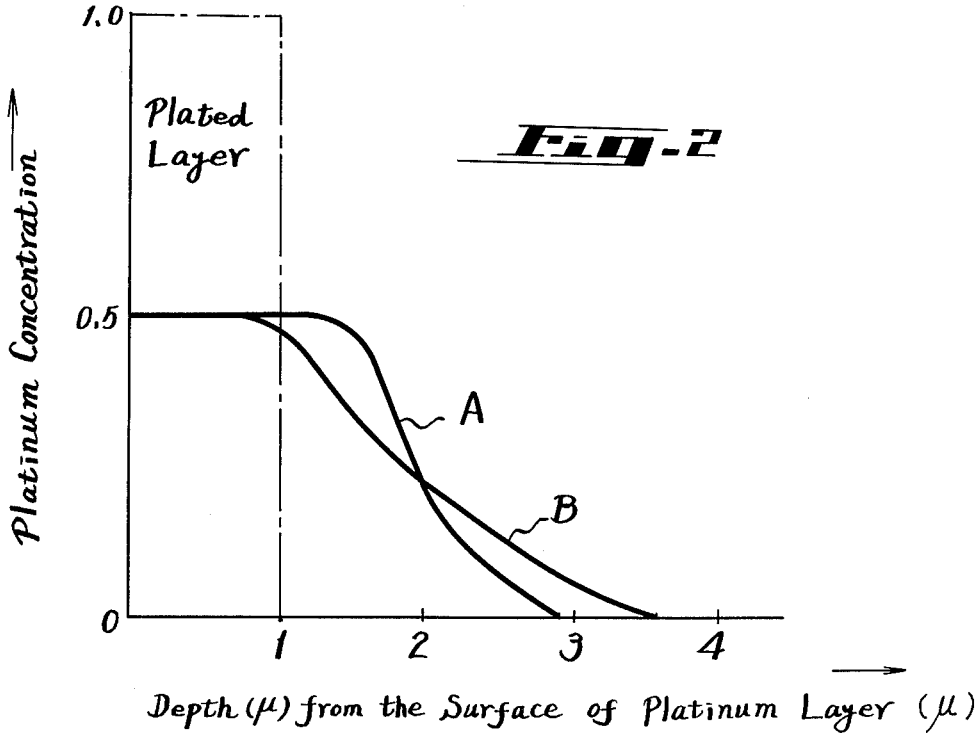
FIG. 2 is a graph showing the concentration of platinum in an ordered alloy of NiPt in the thickness direction from the surface of the platinum.

In FIG. 2 there is shown a graph of the relationship between the depth of a platinum layer from the surface of an NiPt ordered alloy made by the method of the invention described in connection with FIGS. 1A and 1B. In the graph of FIG. 2, the platinum concentration is plotted against the depth of the platinum layer from the surface of the ordered alloy. When a platinum layer is deposited on a nickel base with a thickness of 1 micron, the platinum concentration is shown in FIG. 2 by the broken line. After the platinum layer and the nickel base are heat treated for 3 hours at a temperature of 550° C, the platinum concentration becomes as shown by curve A in FIG. 2 resulting from the diffusion of platinum into the nickel base, and diffusion of the nickel base into the platinum layer. From FIG. 2 it will be seen that there is a substantially uniform composition NiPt ordered layer formed over a range of approximately 1.3 microns and that the platinum concentration is decreased exponentially as the depth becomes greater than 1.3 microns from the surface.

When the same material is further heated for two hours at the same temperature as previously mentioned, the NiPt ordered alloy layer becomes thinner, on the order of about 0.7 microns as shown in FIG. 2 by curve B but the platinum concentration in this range is not changed.

It may be apparent from a description of FIG. 2 that when the platinum layer of a suitable thickness is deposited on a nickel base and when they are heat treated only, an ordered alloy layer is produced which has a thickness according to the heat treatment time. Accordingly, with the method of this invention, it is no longer necessary to employ predetermined compositional ratios as required in the prior art method of making an alloy ingot.

With the method of the present invention, the substantially ordered alloy layer is formed integrally with the metal base by thermal diffusion, so that the adhesion of the ordered layer to the metal base is very strong and the ordered alloy layer is not readily peeled off from the metal base. Furthermore, if only the substantially ordered alloy formed on the metal base is desired, the metal base can be removed, for example, by etching after the ordered alloy layer is formed on the surface of the base.

Figure 3A:
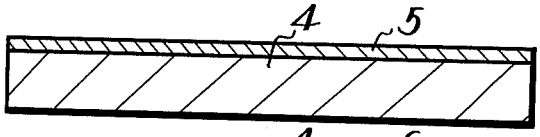
FIGS. 3A and 3B and FIGS. 4A and 4B are cross-sectional views on a greatly enlarged scale illustrating, respectively, the steps involved in other examples of the methods of the present invention.
Figure 3B:
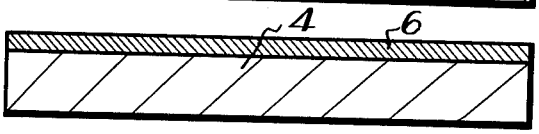

FIGS. 3A and 3B illustrate processes for making a ternary ordered alloy according to this invention. The ternary alloy $Pt_4Ni_3Co$ will be used as an example. In this case, an alloy base containing two elements of the desired ternary alloy, for example, an alloy base 4 made of $Ni_3Co$ is provided and a metal layer 5 composed of platinum is deposited on the surface of the alloy base 4 without quantification by plating, vapor deposition, sputtering or the like with a predetermined thickness as shown in FIG. 3A. Thereafter, the alloy base 4 with the overlying metal layer 5 is heat treated at a temperature lower than the order-disorder transformation temperature of the $Pt_4Ni_3Co$ alloy but higher than the thermal diffusion temperature of $Ni_3Co$ and Pt. In this manner, an ordered alloy layer 6 of $Pt_4Ni_3Co$ with a uniform thickness can be formed on the surface of the alloy base 4 as shown in FIG. 3B.

Figure 4A:
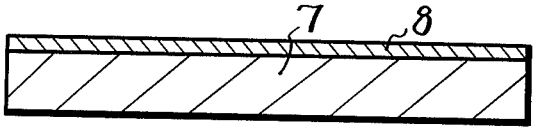
Figure 4B:
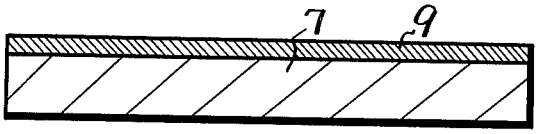

FIGS. 4A and 4B illustrate a further embodiment of the invention. As shown in FIG. 4A a nickel base 7 is provided and then a $Pt_4Co$ alloy layer 8 which contains platinum and cobalt at the atomic ratio 4:1 is deposited on the surface of the nickel base 7 by plating, vapor deposition, sputtering or the like. Alternatively, a platinum layer and then a cobalt layer at an atomic ratio of 4:1 is sequentially formed on the surface of the nickel base 7. Thereafter, the coated base is subjected to a heat treatment above the diffusion temperature but below the order-disorder transformation temperature to provide an ordered alloy layer 9 of $Pt_4Ni_3Co$.

In the last-named example, the platinum and cobalt must be quantified, but at least the surface layer of the nickel base 7 can be provided with an ordered alloy layer 9 of $Pt_4Ni_3Co$. In this case, there is no possibility that an alloy layer of a composition different from that of the ordered alloy $Pt_4Ni_3Co$ can be formed and also the adhesion of the ordered alloy layer 9 to the nickel base 7 is strong.

The following examples illustrate specific embodiments of the invention.

EXAMPLE 1

A gold layer was deposited on a copper base plate with a thickness of one micron by vapor deposition in vacuum and the plated base was subjected to a heat treatment for three hours in hydrogen at a temperature of 340° C. This resulted in a single phase of an ordered layer of AuCu. This ordered layer has excellent anti-abrasion characteristics and anti-corrosion characteristics as well as a low electrical resistance so that the alloy thus made is suitable for use as an electrical contact. When the same material is subjected to heat treatment under the same conditions for 15 hours, an ordered alloy layer of $Cu_3Au$ was formed.

EXAMPLE 2

A layer of platinum was deposited on a copper base by electroplating with a thickness of 1 micron, and the coated base heat treated in a hydrogen atmosphere at a temperature of 340° C for 3 hours. It was confirmed that the resulting structure had a platinum layer, an ordered alloy layer of PtCu, an ordered alloy layer of $PtCu_3$ and a copper layer in order successively from the top surface of the platinum layer.

EXAMPLE 3

The same material as in Example 2 was subjected to a heat treatment at a temperature of 400° C for 1 hour. In this case, a single phase of an ordered alloy $PtCu_3$ was formed on the surface. This ordered alloy had excellent anti-abrasive characteristics and anti-corrosion characteristics and was low in electrical resistance, so that the ordered alloy could be used as an electrical contact.

EXAMPLE 4

The same material as used in Example 2 was heat treated under a temperature of 500° C for 1 hour. In this case an ordered alloy of $PtCu_3$ was formed on the copper base of the single phase.

EXAMPLE 5

Cobalt was plated on the surface of a zinc base to a thickness up to 10 microns and then platinum was plated thereon to a thickness of 2 microns. Thereafter, the zinc base was selectively etched away with an alkali etchant. Next, the laminated cobalt and platinum were heat treated in a hydrogen gas flow at a temperature of 550° C for 4 hours. An ordered alloy of PtCo and a cobalt phase were formed. Thereafter, the cobalt phase layer was dissolved away by hydrochloric acid solution to provide an ordered alloy layer of PtCo. The magnetic characteristics of the resulting ordered alloy layer of PtCo were measured as follows:

Coercive force $H_c = 4500$ oersteds

Squareness ratio $Br/B_S = 0.80$

From the above measurements, it is apparent that the ordered layer of PtCo can be used as a permanent magnet material.

EXAMPLE 6

On an alloy base of 75% nickel and 25% cobalt, there was plated a platinum layer with a thickness of 2 microns and the resulting material was heat treated with a hydrogen gas flow at a temperature of 550° C for 2 hours. An ordered alloy of $Pt_4Ni_3Co$ was formed on the $Ni_3Co$ base as a single phase. After the heat treatment, the $Ni_3Co$ base was dissolved away with hydrochloric acid solution. The magnetic characteristics of the thus formed ordered layer of $Pt_4Ni_3Co$ were measured as follows:

Coercive force $H_c = 1900$ oersteds

Squareness ratio $Br/B_S = 0.80$

Curie temperature $T_c = 120°$ C

The above magnetic characteristics are substantially the same as those of the ordered alloy material $Pt_4Ni_3Co$ formed by the prior art alloy ingot method, and so the ordered alloy of Example 6 could be used as an intermediate recording medium in thermal and magnetic printing.

EXAMPLE 7

The material used in Example 6 was heat treated at a temperature of 500° C for 2 hours. An alloy of $Pt_6Ni_3Co$ was formed on the surface, with an ordered alloy of $Pt_4Ni_3Co$ formed therebelow, just above the alloy base of $Ni_3Co$.

When the conditions for heat treatment of Example 6 were varied to employ a temperature of 450° C for 2 hours, it was confirmed that a platinum layer was formed on the outermost surface, a $Pt_{16}Ni_3Co$ layer was formed therebeneath, a $Pt_6Ni_3Co$ layer was formed thereunder, just over the $Ni_3Co$ base.

When the materials used in Example 6 were heat treated at a temperature of 600° C for 2 hours, it was confirmed that a $Pt_2Ni_3Co$ alloy was formed on the surface of the $Ni_3Co$ base.

In order to understand the characteristics of the ordered alloy layer produced by this invention, a comparison of the characteristics of the ordered alloy with those of a disordered alloy of the same composition was carried out with respect to the anti-corrosion properties, anti-abrasion properties and electrical resistivity at room temperature.

An alloy layer of $Pt_4Ni_3Co$, a disordered alloy layer, was made by plating the same directly on a copper base plate with a thickness of 2 microns. This alloy layer was dissolved in a 4 normal hydrochloric acid solution in about 2 or 3 days. In contrast, an ordered alloy layer of $Pt_4Ni_3Co$ produced according to the present invention by diffusion of platinum into an $Ni_3Co$ base was not corroded by a 4 normal hydrochloric acid solution.

An alloy layer of AuCu, a disordered alloy layer, was made by plating CuAu directly on a copper base plate with a thickness of 2 microns. This alloy layer disappeared in a 4 normal hydrochloric acid solution in 2 or 3 days. In contrast, an alloy layer of AuCu in the form of an ordered alloy layer of the present invention formed by heat diffusion of gold into a copper base plate was not corroded by 4 normal hydrochloric acid solution.

The anti-abrasion characteristics of the materials were determined as follows. The alloys were used to form tape guides of a tape recorder and an ordinary magnetic tape was transported in contact with the tape guides under tape tensions of 50 and 100g at a speed of 19cm/sec. The abrasion of the tape guides was measured, resulting in the following measurements:

Table 1

| Specimen | Amount of Abrasion | |
|---|---|---|
| | Tape Tension 50g | Tape Tension 100 g |
| Disordered AuCu Alloy Material | 0.2 micron/hour | 0.57 micron hour |
| Ordered AuCu Alloy Material (made by prior art) | 0.05 micron/hour | 0.14 micron/hour |
| AuCu Alloy Material of the Invention | 0.06 micron/hour | 0.13 micron/hour |

The electrical resistivity of the ordered alloy material was substantially decreased as compared with that of the disordered alloy material, as evident from the following result:

Table II

| Specimen | Resistivity |
|---|---|
| Disordered AuCu Alloy Material | 14 μΩ cm |
| Ordered AuCu Alloy Material | 4 μΩ cm |
| Disordered $AuCu_3$ Alloy Material | 12μΩ cm |
| Ordered $AuCu_3$ Alloy Material | 4 μΩ cm |

The method of the present invention is applicable to production of any type of ordered alloy between two or more metals. Various binary alloys of the ordered type to which the invention is applicable, and their order-disorder transformation temperatures are summarized in Table III.

Table III

| Alloy | Order-Disorder Transformation Temperature ° C | Alloy | Order-Disorder Transformation Temperature ° C | Alloy | Order-Disorder Transformation Temperature ° C |
|---|---|---|---|---|---|
| CuAu | 380 | $Cu_3Au$ | 390 | $Mg_3Cd$ | 150 |
| CoPt | 825 | $Au_3Li$ | ~600 | $Cd_3Mg$ | 80 |
| NiPt | ~645 | $Mg_3In$ | ~350 | $Ni_3Sn$ | 850~920 |

Table III-continued

| Alloy | Order-Disorder Transformation Temperature ° C | Alloy | Order-Disorder Transformation Temperature ° C | Alloy | Order-Disorder Transformation Temperature ° C |
|---|---|---|---|---|---|
| FePt | ~1300 | $Cu_3+Pt$ | ~645 | $Au_4Cr$ | ~400 |
| FePd | ~700 | $Ag_3Pt$ | 785 | $Ir_3Mo$ | >1600 |
| InMg | 330 | $Au_3Pd$ | ~850 | $Rh_3W$ | >1200 |
| NiMn | ~750 | $Cu_3Pd(\alpha')$ | ~500 | $Ni_3V$ | 1045 |
| CuZn | 468 | $Ni_3Fe$ | 500 | $Pd_3V$ | 815 |
| FeCo | 730 | $Ni_3Mn$ | 510 | $Pd_3Nb$ | ~1200 |
| CuPd | 600 | $Mn_3Pt$ | ~1050 | $Ni_2V$ | 920 |
| AuMn | 615 | $Fe_3Pt$ | 835 | $Ni_2Cr$ | 580 |
| AgZn | ~130 | $Ni_3Pt$ | 580 | $Pd_2V$ | 905 |
| AgCd | 235 | $In_3Mg$ | ~110 | $Pt_2V$ | over 1100 |
| CoAl | >740 | $Pd_3Au$ | ~800 | $Cr_2Al$ | ~860 |
| MgCd | 250 | $Fe_3Ni$ | ~800 | $U_2Mo$ | ~600 |
| MoRh | 950~1200 | $Pt_3Mn$ | ~1000 | | |
| MoIr | 1570~1650 | $Pt_3Co$ | ~750 | | |
| WIr | >1200 | $Pd_3Fe$ | ~800 | $Ni_4Mo$ | ~860 |
| $Fe_3Al$ | 550 | $Ag_3Mg$ | 393 | $Ni_4W$ | ~970 |
| $Fe_3Si$ | ~1200 | $Au_3Cd$ | 412 | $Au_4V$ | ~565 |
| $Cu_3+Pd$ | ~480 | $Cu_3Pt$ | ~600 | $Au_4Mn$ | ~420 |

Many of the noted alloys of the present invention can be produced by simply plating the components onto a base containing the other constituents. As examples of such platable alloys as gold, copper, platinum, palladium, cobalt, nickel, zinc, silver, cadmium, rhodium, iridium, chromium, and tin.

Ordered alloys such as CoPt, FePt, $Pt_4Ni_3Co$ and the like can be utilized as magnetic recording media. Ordered alloys of CuPt, CuAu, FePt, AgPt, CuPd and the like can be employed as electrical contact materials. The ordered alloys CuPt, FeNi, FeAl, FePd, CuAu, $Fe_3Pt$ and the like can be used as anti-corrosion materials. $Ni_3Mn$ alloy can be used as a magnetic head material.

As described in the foregoing, the ordered alloy of the present invention can be made without quantifying the amount of metals which form the ordered alloys, the surface layer of a metal base can be provided with an ordered alloy layer of a constant thickness, and ordered layers of predetermined characteristics can be prepared.

In the above examples of the invention, it is preferable that the metal base and the deposited layer contain no impurities, but impurities can be tolerated in such an amount as not to prevent the formation of the ordered phase.

It will be apparent that many modifications or variations can be effected by one skilled in the art through the described embodiments without departing from the spirit or scope of the invention.

We claim as our invention:

1. A method for making a substantially ordered alloy containing at least a first metallic element and a second metallic element comprising the steps of:

(a) providing a solid, imperforate metal base consisting of at least said first metallic element, (b) depositing a thin metal layer on said base, said metal layer consisting of at least said second metallic element, said second metallic element being capable of forming an ordered alloy with said first metallic element, said metal layer being not in excess of 10 microns in thickness, and (c) heating said metal base and the deposited metal layer at a temperature below the order-disorder transformation temperature of the ordered alloy to be made for a sufficient length of time to cause diffusion of said deposited metal into said metal base and formation of a continuous layer of ordered alloy between the two metals.

2. A method of making an ordered alloy as claimed in claim 1, in which said ordered alloy is a binary alloy.

3. A method of making an ordered alloy as claimed in claim 2, in which said metal base consists solely of the first metallic element and said metal layer consists solely of the second metallic element.

4. A method of making an ordered alloy as claimed in claim 1, in which the depositing step is carried out by vapor deposition.

5. A method of making an ordered alloy as claimed in claim 1, in which said depositing step is carried out by plating.

6. A method of making an ordered alloy as claimed in claim 1, in which said depositing step is carried out by chemical vapor deposition.

7. A method of making an ordered alloy as claimed in claim 1, in which said depositing step is carried out by sputtering.

8. A method of making an ordered alloy as claimed in claim 1, in which said deposited metal layer consists of two elements with a predetermined atomic ratio.

9. A method of making an ordered alloy as claimed in claim 1, in which said deposited layer consists of two layers of different metallic elements.

* * * * *